US007036898B2

(12) United States Patent
Edelen et al.

(10) Patent No.: US 7,036,898 B2
(45) Date of Patent: May 2, 2006

(54) SUPPLYING POWER TO LOGIC SYSTEMS IN PRINTERS

(75) Inventors: John G. Edelen, Versailles, KY (US); George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 208 days.

(21) Appl. No.: 10/738,794

(22) Filed: Dec. 17, 2003

(65) Prior Publication Data

US 2005/0134618 A1 Jun. 23, 2005

(51) Int. Cl.

| | |
|---|---|
| ***B41J 29/38*** | (2006.01) |
| ***B41J 2/14*** | (2006.01) |
| ***B41J 2/16*** | (2006.01) |
| ***B41J 2/05*** | (2006.01) |

(52) U.S. Cl. ..... 347/9; 347/50; 347/57

(58) Field of Classification Search ..... None
See application file for complete search history.

(56) References Cited

U.S. PATENT DOCUMENTS

| | | | |
|---|---|---|---|
| 4,901,217 | A | 2/1990 | Wilson |
| 4,941,004 | A | 7/1990 | Pham et al. |
| 5,438,678 | A | 8/1995 | Smith |
| 5,519,634 | A | 5/1996 | Matsuura et al. |
| 5,550,985 | A | 8/1996 | Miller et al. |
| 6,041,105 | A | 3/2000 | Wu et al. |
| 6,061,800 | A | 5/2000 | Chiu |

*Primary Examiner*—K. Feggins
*Assistant Examiner*—Julian D. Huffman
(74) *Attorney, Agent, or Firm*—Luedeka, Neely & Graham, P.C.

(57) ABSTRACT

Power is provided from one portion of a printer, such as a printer electronics module, to another portion of the printer, such as a printhead. Logic signals produced in a first electronic module of the printer are transmitted to a second electronics module of the printer. A power signal is derived from the logic signals without interfering with the magnitude or duration of logic signals, and the logic power signal is applied to power the second electronic module without having a separate dedicated power line.

16 Claims, 2 Drawing Sheets

SUPPLYING POWER TO LOGIC SYSTEMS IN PRINTERS

FIELD OF THE INVENTION

The present invention relates to supplying power to logic in a printhead and particularly relates to supplying power to a logic circuit in a printhead using existing circuitry to configure a local power supply on a printhead.

BACKGROUND AND SUMMARY OF THE INVENTION

In typical printers, integrated circuits or chips are provided on printheads for performing signal processing. Usually, these chips interpret serial data streams containing encoded data for controlling the printing operation, such as the production of a printed image or data, and control of the printhead itself. The types of signals provided to the chip on the printhead would include logic, power, a clear signal, clock signals, such as CLOCK and LOAD, and data signals corresponding to the image or data to be printed. The need to provide numerous signals to the printhead increases the cost of the printer because it requires a large TAB circuit. The TAB circuit provides an interconnection between the printer and printhead, and usually a separate line is required for each type of different signal that is applied to the printhead. Thus, reducing the number of lines in a TAB circuit will significantly reduce the cost of the printer and the printhead.

Another significant factor in the cost of the chip is the size of the chip, and the size of the chip usually goes up in proportion to the number of signals and the types of signals that the chip must interpret. Increasing the size of a chip usually increases its cost.

The present invention reduces the cost of the the printhead by reducing the number of lines in the tab circuit and by reducing the overall size of the circuits required on the tab circuit.

In accordance with one embodiment of the present invention a printhead is provided for use in an inkjet printer in which printer electronics produce logic signals and apply the logic signals to the printhead through an interconnecting circuit. The printhead includes a plurality of nozzles for directing ink out of the printhead, and a plurality of ejector mechanisms that force ink through the nozzles. A printhead power circuit directs power to the ejector mechanisms and a logic power supply is connected to receive at least one logic signal from the interconnecting circuit. The logic power supply derives a power signal from the logic signal and supplies the power signal to a logic circuit. Thus, the logic circuit receives a power signal without having a dedicated logic power line in the interconnecting circuit between the printer electronics and the printhead.

The logic power supply circuit may be a single isolation device connected to a single logic signal. However, it is preferred that the logic power supply circuit be connected to at least two different logic signals and, thus, the logic power supply circuit may comprise two diodes or other electronic isolation devices. The electronic isolation devices, such as diodes, derive power from the logic signals and apply that power to the logic circuit, but the isolation devices also isolate the logic circuit from the logic signals so that power cannot flow in a reverse direction from the logic circuit to the interconnecting circuit or other lines that carry the logic signals.

In a particular embodiment, the logic power supply circuit is part of an electrostatic discharge protection circuit that is connected to a logic signal and to the logic power supply circuit. The electrostatic discharge protection circuit is configured to derive the logic power signal from logic signal and apply the logic power signal to the logic circuit of printhead. The electrostatic discharge protection circuit includes an electronic isolation device, such as a diode, that performs a dual function. It helps protect the circuit against electrostatic discharge, and it derives power from the logic signals and applies that power to logic circuit while simultaneously isolating the logic circuit from logic signals. The term "isolating" in this context means that the isolation device prevents reverse current flow from the logic circuit back to the lines carrying the logic signals, but it allows forward current flow.

In accordance with a method of the present invention, power is provided from one portion of a printer, such as a printer electronics module, to another portion of the printer, such as a printhead. Logic signals are produced in a first electronic module of the printer and are transmitted by an interconnecting circuit to a second electronic module of the printer. A logic power signal is derived from the logic signals without interfering with the magnitude or duration of logic signals, and the logic power signal is applied to power the second electronic module without having a separate dedicated power line in the interconnecting circuit to power the second electronic module. The method may be implemented by deriving a power signal from a single logic signal, but it is preferred that the method be implemented by deriving of the power signal from multiple logic signals, where at least one of the logic signals is active (high) at any point in time. In one embodiment the method is performed by electronic isolation devices that are already present in the printhead performing other functions. For example, the method may be performed by electronic isolation devices that are already present in an electrostatic discharge protection circuit in the printhead. The electronic isolation devices derive a logic power signal from the logic signals while simultaneously providing electrostatic discharge protection. Thus, the method may be implemented with little or no additional cost in the second electronic module of the printer because an isolation device that is already present in the second electronic module is being reconfigured to perform dual functions without sacrificing its original function. For example, two diodes that are already present in an electrostatic discharge protection circuit may be connected to derive the logic power signal from the logic signals without adding any new devices to the second electronics module.

BRIEF DESCRIPTION OF THE DRAWINGS

The present invention may best be understood by reference to exemplary embodiments as shown in the drawings in which.

DETAILED DESCRIPTION OF THE DRAWINGS

Figure 1:
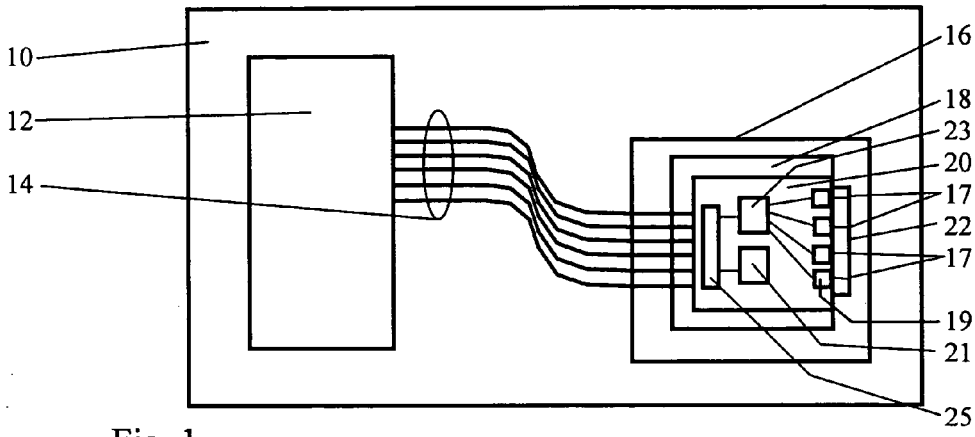
FIG. 1 is a block diagram illustrating a printer constructed in accordance with an embodiment of the present invention.

Referring now to the drawings in which like reference characters designate like or corresponding parts throughout the several views, there is shown in FIG. 1 a block diagram of an inkjet printer 10 constituting an embodiment of the present invention. The printer 10 includes a printer electronics module 12 that is connected to supply signals to an interconnecting circuit 14 such as a TAB circuit. For example, the electronics module 12 receives signals from a computer and generates signals to cause the printer 10 to print the data, such as text or images, as dictated by an external computer. The signals produced by the electronics module 12 would include power signals and logic signals.

At its other end, the interconnecting circuit 14 is interfaced with a printhead 18 that is mounted on a printhead carriage 16. The printhead 18 includes an electronics module 20 and a nozzle plate 22. Nozzles 17 are formed in the nozzle plate 22 and ejector mechanisms 19 disposed within the printhead electronics module 20 will force ink through the nozzles 17 in a desired pattern to produce an image corresponding to the data provided by the outside computer. The printhead electronics module 20 includes a printhead logic module 21 that receives logic signals from the interconnecting circuit 14, a printhead power circuit 23 that receives power from the interconnecting circuit 14, and ejector mechanisms 19 that are selectively powered by the printhead power circuit 23 for ejecting ink through the nozzles 17 of nozzle plate 22. An ESD protection circuit 25 is also provided on the electronics module 20, and it includes numerous different circuits for protecting the module 20 from electrostatic discharge. The power signals supplied on interconnecting circuit 14 are not applied to power the printhead logic module 21 contained within the the printhead electronics module 20. Instead, the logic module 21 is powered by the logic signals themselves.

Figure 2:
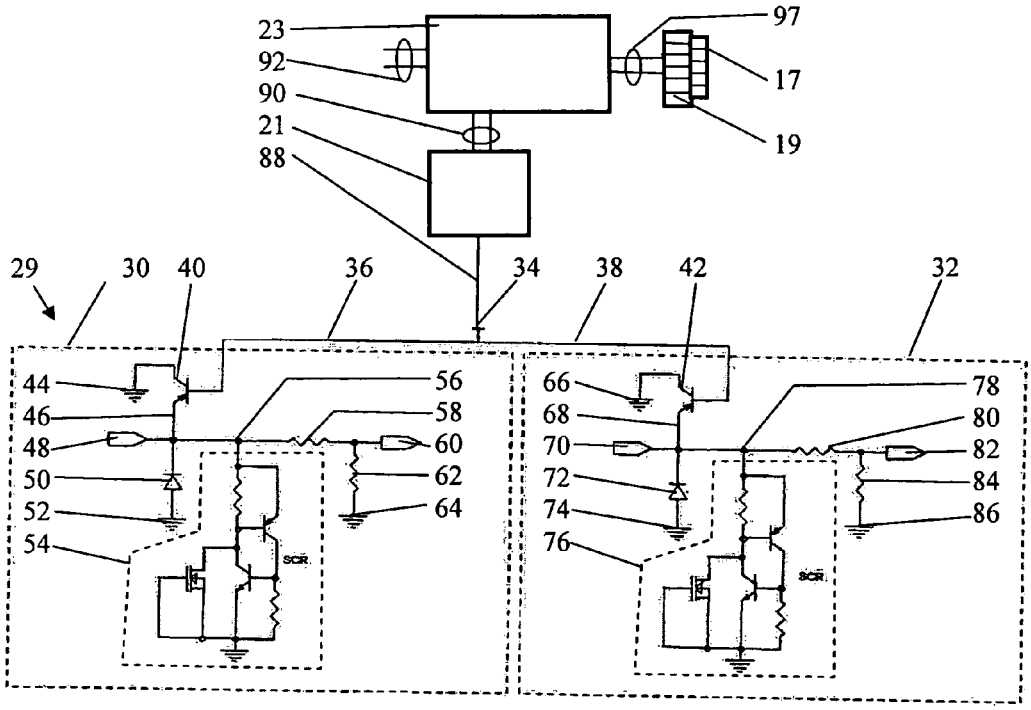
FIG. 2 is a circuit diagram illustrating two electrostatic discharge protection circuits configured to also function as a logic power supply for a logic circuit.

Referring now to FIG. 2, a logic power supply 29 is shown. This power supply is disposed on the printhead electronics module 20 and provides power from the logic lines to the logic module 21. The logic power supply 29 includes electrostatic discharge protection circuits 30 and 32, which are part of the ESD circuit 25 (electrostatic discharge circuit) shown in FIG. 1. Power is supplied on output terminal 34 by the circuit 29, and the electrostatic discharge protection circuits 30 and 32 are connected to output terminal 34 by lines 36 and 38, respectively.

Line 36 is connected to the gate of a bipolar transistor 40 which functions as a diode. The collector of transistor 40 is connected to ground 44 and the emitter is connected through line 46 to a logic input 48. The emitter of transistor 40 is also connected through line 46 to the cathode (N-side) of a diode 50 whose (P-side) is connected to ground 52. Also connected to the emitter of transistor 40 at junction 56 is a silicon controlled rectifier 54, and an output resistor 58. A ground resistor 62, connected to ground 64, and an output 60 are connected to the output resistor 58.

In this configuration, a logic signal is applied through input 48 and it is output through the output resistor 58 and output 60. Thus, a logic signal appearing on input 48 is passed to output 60 and thereafter it is used in the printhead electronics module 20 in its normal capacity. However, in addition to passing the logic signal from the input 48 to the output 60, the ESD circuit 30 provides electrostatic discharge protection. Additionally, in accordance with an embodiment of the present invention, the logic signal appearing on input 48 passes through the transistor 40, experiences a voltage drop of 0.6 volts, and is applied to output terminal 34 as a power signal.

ESD circuit 32 is identical to circuit 30, except that it receives a different logic signal and produces a different output power signal on line 38. A bipolar transistor 42 has its gate connected to line 38 and in the configuration shown in FIG. 2, the transistor 42 functions as diode. The collector of transistor 42 is connected to ground 66, and the emitter is connected through line 68 to input 70. A diode 72 is also connected to line 68 and the anode of the diode 72 is connected to ground 74. A silicon controlled rectifier 76 is connected between ground and the emitter of transistor 42, and the connection is made at the junction 78. An output resistor 80 is also connected to the junction 78, and the other side of resistor 80 is connected to a ground resistor 84 that is connected to ground 86. An output 82 is also connected between the output resistor 80 and ground resistor 84. In this configuration, the ESD circuit 32 functions like the circuit 30. An input logic signal is applied to the input 70 and this signal is passed to the output 82 for use in the electronics module 20 in its normal capacity. Electrostatic discharge protection is provided and, in addition, a logic power signal is applied through the transistor 42, functioning as a diode, to the line 38 and the output terminal 34. Thus, two different logic power signals appear on lines 36 and 38 and are both applied to the output terminal 34. Both of the logic power signals may be active at the same time, but the logic signals applied at inputs 48 and 70 are chosen so that one of those logic signals will be active (e.g. high) at any given point in time. Thus, the logic power signal appearing at output terminal 34 is constantly active thereby providing a constant DC power signal for the logic module 21.

The logic power signal appearing on the output terminal 34 is applied through line 88 to the logic module 21 thereby supplying power to the printhead logic circuitry. Logic signals are applied by the logic module 21 through lines 90 to the power circuit 23, and power signals are applied to the power circuit 23 through power lines 92. In response to the logic signals appearing on line 90, the power circuit 23 applies power signals through lines 97 to one or more of the ejector mechanisms 19, and in response to the power signals, the ejector mechanisms 19 force ink through the nozzles 17 to print an image or data on media.

In this embodiment, the transistors 40 and 42 (which function as diodes) are already present on the ESD circuits 30 and 32. Thus, the power supply for the logic module 21 may be implemented on the electronics module 20 without increasing the size of the electronics (usually an integrated circuit) and without any additional cost. The logic module 21 is designed to require a low power level so that power may be withdrawn from the logic signals themselves without affecting the duration or amplitude of the logic signals appearing on inputs 48 and 70.

While only two circuits 30 and 32 have been shown in FIG. 2, it will be understood that this circuit is intended to represent a printer having multiple circuits 30 and 32. Typically, a printer electronics module 20 would include at least one such ESD circuit for each logic signal that is input to the printhead 18. Additional ESD circuits would be provided for the power lines themselves, and for other inputs and outputs of the printhead 18.

In this embodiment, transistors 40 and 42 are performing an isolation function by allowing power to flow to the terminal 34 from the inputs 48 and 70, but reverse power flow is not allowed thereby protecting the logic signals on outputs 60 and 82 from possible interference from logic circuit 21. The isolation function is also a rectification function which produces the desired logic power signal. The isolation function also prevents interference between the logic signals appearing on inputs 48 and 70.

Figure 3:
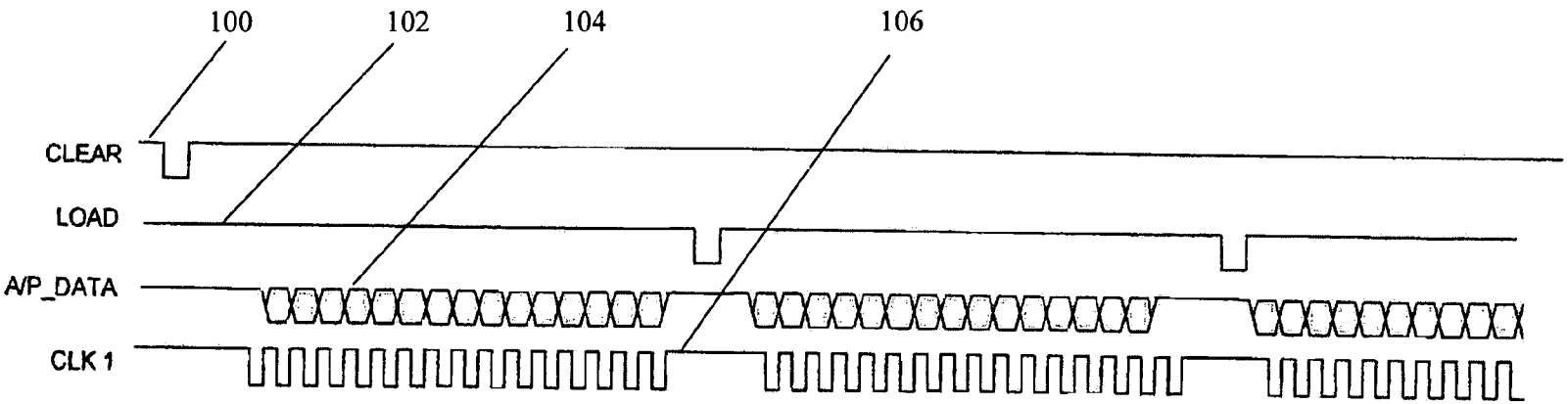
FIG. 3 is a graph of four logic signals that may be used for deriving a logic power signal.

Referring to FIG. 3, graphics are provided to illustrate typical logic signals in a printhead. For example, in a typical printhead, a clear signal would appear on line 100, a load signal on line 102, a data signal on line 104, and a clock signal on line 106. There may also be other logic signals that would be useful in the current invention, but these are provided as examples. To provide power in accordance with an embodiment of the present invention, the aforementioned logic signals are chosen such that one of the signals will be high or active at any given point in time. Then, one of the chosen signals is applied to input 48 and the other is applied to input 70. Acceptable combinations of selected signals for application to inputs 48 and 70 are as follows:

Clock and load;
Clear and clock;
Clear and load;
Clear and data;
Data and load;
Clear and data and clock (for 3 logic signal embodiment).

Although the invention is described herein with reference to deriving power from two logic signals, it will be understood that alternate embodiments could use more than two logic signals or a single logic signal from which a logic power signal is derived.

Figure 4:
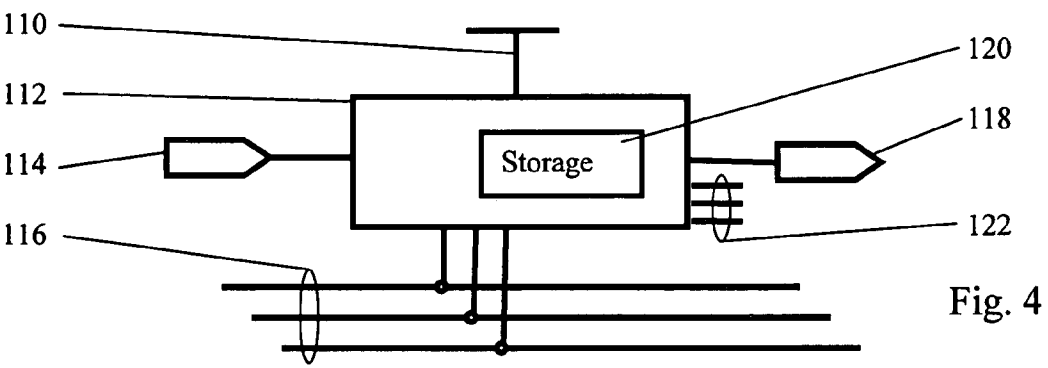
FIG. 4 is a circuit diagram of a logic power supply circuit for deriving a logic power signal from one or more logic signals.

To illustrate these alternate embodiments of the invention, FIG. 4 is shown representing a generalized logic power supply circuit 112. This logic power supply circuit 112 produces a logic power signal on the power output terminal 110. It receives a logic signal on input 114 and it transfers the logic signal to the output 118. As the logic signal passes through the power supply circuit 112, a power signal is derived from the single logic signal appearing on input 114 and the power signal is applied to the output terminal 110. Since the logic signal appearing on input 114 will not be constantly active, a storage device 120 is provided to store power while the logic signal 114 is active and to supply power to the output terminal 110 when the logic signal is not active. The storage device 120 includes an electronic isolation circuit such that it can receive power from the logic signal, but it cannot supply power back to the output 118 or the input 114. Thus, the storage device 120 only supplies power to the output terminal 110.

To further generalize the embodiments illustrated by FIG. 4, optional connections to a logic lines 116 are illustrated. The power supply circuit 112 may derive multiple power signals from the logic signals appearing on logic lines 116 and all of the power signals are applied to the power output terminal 110. If multiple logic signals are used such that at least one logic signal is active at any given point in time, it is not necessary to provide a storage device 120 and it may be omitted. However, if desired, the storage device may be included for redundancy. Depending upon the application, the storage device may be a capacitor circuit, a battery circuit, or even an inductive circuit. In addition to deriving power from the logic line 116, the circuit 112 transfers the logic signals appearing on lines 116 to lines 122. As before, the power demands placed upon the logic signals are sufficiently low that the circuit 112 will not interfere with the logic signals. That is, the amplitude and duration of the logic signals will remain substantially unchanged by the supply circuit 112.

While the present invention has been described with reference to several embodiments that are discussed as examples, it will be understood that the invention is capable of numerous rearrangements, modifications, and substitutions of parts without departing from the scope and spirit of the invention as defined in the appended claims.

The invention claimed is:

1. A printhead for use in an inkjet printer having printer electronics producing logic signals and applying the logic signals to the printhead through an interconnecting circuit, the printhead comprising:

a plurality of nozzles for directing ink out of the printhead;

a plurality of ejector mechanisms for forcing ink through the nozzles;

a printhead power circuit for directing power to the ejectors;

a logic circuit for receiving logic signals from the printer electronics and controlling the printhead power circuits to apply power to selected ejector mechanisms;

a logic power supply connected to receive at least one logic signal, derive a logic power signal from the logic signal, and supply the logic power signal to the logic circuit, whereby the logic circuit receives a power signal without having a separate dedicated logic power line in the interconnecting circuit between the printer electronics and the printhead.

2. The printhead of claim 1 wherein said logic power supply circuit comprises at least one isolation device connected to receive a logic signal and the printhead further comprise a storage device connected to receive power from said logic signal and to supply power to said logic circuit.

3. The printhead of claim 1 wherein said logic power supply circuit comprises at least two diodes, each of said diodes being connected to different logic signals.

4. The printhead of claim 1 wherein said logic power supply circuit comprises an electrostatic discharge protection circuit that is connected to a logic signal and to the logic power supply circuit, the electrostatic discharge protection circuit being configured to derive the logic power signal from the logic signal and to apply the logic power signal to the logic circuit of the printhead.

5. The printhead of claim 1 wherein said logic power supply circuit comprises an electrostatic discharge protection circuit that is connected to a plurality of logic signals, said plurality of logic signals being chosen such that at least one of the logic signals is active at any point in time, said electrostatic discharge protection circuit being configured to derive a DC continuous logic power signal from the plurality of logic signals and being connected to apply the logic power signal to the logic circuit of the printhead.

6. An inkjet printer comprising:

printer electronics for producing a plurality of logic signals such that at least one logic signal is active at any point in time during operation of the printer;

said printer electronics for producing a power signal for ejecting ink from the inkjet printer;

an interconnecting circuit for receiving the logic signals and the power signal;

a plurality of nozzles for directing ink out of the printhead;

a plurality of the ejector mechanisms for forcing ink through the nozzles;

a printhead power circuit for receiving the power signal from the interconnecting circuit and directing power to the ejector mechanisms;

a logic circuit for receiving the logic signals from the interconnecting circuit and for producing control signals that are applied to the printhead power circuit to control the application of power to the ejector mechanisms;

a logic power supply circuit connected to receive the logic signals from the interconnecting circuit, for deriving a logic power signal from the logic signals, and supplying the logic power signal to the logic circuit.

7. The printer of claim 6 wherein said logic power supply circuit comprises an isolation circuit connected to at least one of the plurality of logic signals.

8. The printer of claim 6 wherein said logic power supply circuit comprises a plurality of diodes, each diode being connected to receive a different logic signal.

9. The printer of claim 6 wherein said logic power supply circuit comprises an electrostatic discharge protection circuit configured and connected to receive a plurality of logic signals, to derive a power signal from of the plurality of logic signals, and to supply the logic power signal to the logic circuit of the printhead.

10. The printer of claim 6 wherein said logic power supply circuit comprises an electrostatic discharge protection circuit configured and connected to receive a plurality of logic signals, said plurality of logic signals being chosen such that at least one of the plurality of logic signals is active at any one time, said electrostatic discharge protection circuit being configured to derive a continuous power signal from the plurality of logic signals, and to supply the logic power signal to the logic circuit of the printhead.

11. A method for producing logic signals in an inkjet printer having printer electronics and applying the logic signals to a printhead through an interconnecting circuit, the method comprising:

directing ink out of the printhead through a plurality of nozzles;

directing power to a plurality of ejector mechanisms using a printhead power circuit;

receiving logic signals from the printer electronics with a logic circuit;

controlling the printhead power circuit to apply power to selected ejector mechanisms;

receiving at least one logic signal at a logic power supply;

deriving a logic power signal from the logic signal; and supplying the logic power signal to the logic circuit without having a separate dedicated logic power line in the interconnecting circuit between the printer electronics and the printhead.

12. The method of claim 11 wherein the step of deriving a logic power signal comprises deriving the logic power signal with a portion of an electrostatic discharge protection circuit.

13. The method of claim 11 wherein the step of producing logic signals further comprises producing logic signals such that at least one logic signal is active at any point in time.

14. The method of claim 11 wherein the step of producing logic signals further comprises producing logic signals such that at least one of the logic signals is active at any point in time and wherein the step of deriving a power signal from the logic signals further comprises deriving a continuous power signal from a group of logic signals in which at least one logic signal in the group is active at any point in time.

15. The method of claim 11 wherein the step of producing logic signals further comprises producing logic signals such that at least one of the logic signals is active at any point in time and wherein the step of deriving a power signal from the logic signals further comprises deriving a continuous power signal with at least two diodes.

16. The method of claim 11 wherein the step of producing logic signals further comprises producing logic signals such that at least one of the logic signals is active at any point in time and wherein the step of deriving a power signal from the logic signals further comprises deriving a continuous power signal with at least two diodes that are present in an electrostatic discharge protection circuit.

* * * * *